US005401361A

United States Patent [19]

Prough et al.

[11] Patent Number: 5,401,361

[45] Date of Patent: Mar. 28, 1995

[54] COMPLETELY COUTERCURRENT COOK CONTINUOUS DIGESTER

[75] Inventors: J. Robert Prough; C. Bertil Stromberg; Richard O. Laakso; Bruno S. Marcoccia, all of Glens Falls, N.Y.

[73] Assignee: Kamyr, Inc., Glen Falls, N.Y.

[21] Appl. No.: 963,492

[22] Filed: Oct. 20, 1992

Related U.S. Application Data

[63] Continuation-in-part of Ser. No. 931,983, Aug. 19, 1992, abandoned.

[51] Int. Cl.[6] ..... D21C 7/00; D21C 3/24

[52] U.S. Cl. ..... 162/17; 162/39; 162/41; 162/238

[58] Field of Search ..... 162/17, 19, 39, 41, 162/43, 238, 251, 55

[56] References Cited

U.S. PATENT DOCUMENTS

| | | | |
|---|---|---|---|
| 3,097,987 | 7/1963 | Sloman | 162/17 |
| 3,294,623 | 12/1966 | Brinkley, Jr. et al. | 162/19 |
| 3,654,070 | 4/1970 | Pradt et al. | 162/55 |
| 5,053,108 | 10/1991 | Richter | 162/37 |
| 5,069,752 | 12/1991 | Richter | 162/251 |
| 5,089,086 | 2/1992 | Silander | 162/19 |

FOREIGN PATENT DOCUMENTS 0476230 3/1992 European Pat. Off. .

OTHER PUBLICATIONS

Sven Rydohlm, "Continuous Pulping Processes", Tech. Assoc. of Pulp & Paper Ind., No. 7, 1970, pp. 124–133.

"CPPA Tech '91" Kraft Pulping Course, Continuous Digesters Section III-MCC, Greenwood, B., Kamyr, Inc., Apr. 1991, 3.1–3.4.

*Primary Examiner*—W. Gary Jones
*Assistant Examiner*—Dean T. Nguyen
*Attorney, Agent, or Firm*—Nixon & Vanderhye

[57] ABSTRACT

A conventional continuous digester is modified so as to provide a countercurrent cook throughout the entire height of the digester. Instead of connecting an upper mid-point extraction screen to a flash tank, that screen is closed off and extraction is provided at the top of the digester, utilizing an in-line drainer to remove some of the liquor and feed it to a flash tank. The liquor not removed recirculates through a pressure screen to an impregnation vessel, and then back to the digester. A cooling circulation is provided just below the top extraction. Valves are provided in the liquor discharged from the drainer and a conduit from the upper mid-point extraction which may be manipulated to return the digester to conventional operation, including the addition of white liquor to the bottom recirculation.

18 Claims, 3 Drawing Sheets

COMPLETELY COUTERCURRENT COOK CONTINUOUS DIGESTER

CROSS-REFERENCE TO RELATED APPLICATIONS

This application is a continuation-in-part of application Ser. No. 07/931,983, filed Aug. 19, 1992 (now abandoned).

BACKGROUND AND SUMMARY OF THE INVENTION

Over the last decade, two significant advances have taken place in continuous cooking technology for the production of cellulosic pulp, primarily in the practice of the sulphate process, but also for use in the sulfite and other processes. First, with the advent of MCC™ digesters from Kamyr, Inc., a significant countercurrent cook zone was established in the middle of the digester by introducing white liquor into a central recirculation loop. Subsequently, EMCC® digesters developed by Kamyr, Inc., provided for further countercurrent cooking by introducing white liquor into the bottom (wash) circulation loop, as seen in copending application Ser. No. 07/583,043, filed Sep. 17, 1990 (now abandoned). These digesters have been commercially successful because they enhance the quality of the pulp produced. In both these commercial digesters, however, the first cooking zone is a co-current zone.

According to the present invention it has been found that if the entire cook in a continuous digester is made countercurrent, the temperature of the cook can be lowered, or more uniform and better temperature control can be provided. Lower temperatures or more uniform temperature control limits the damage to fibers that large temperature swings can cause, resulting in a better quality fiber, and therefore increased strength and yield of pulp.

While it is desirable to take advantage of the improvements compared to conventional cooks set forth above, under some circumstances it may still be desirable to run a digester with conventional processes, e.g. run it as an EMCC® digester. Therefore, it is desirable to construct a digester that can be switched over from the completely countercurrent process of the invention, to a conventional form of digester, such as an EMCC® digester.

According to the method of the present invention, cellulosic pulp is produced from comminuted cellulosic fibrous material utilizing an upright digester having a top and a bottom. The method comprises the following steps: (a) Continuously introducing comminuted cellulosic fibrous material entrained in cooking liquor into the top of the digester so that the material continuously moves downwardly in the digester. (b) Continuously withdrawing cellulose pulp from the bottom of the digester. And, (c) establishing a countercurrent flow between cooking liquor and material throughout the entire height of the digester between the material introduction at the top and the pulp withdrawal at the bottom, including continuously withdrawing liquid from the digester at various points and reintroducing the withdrawn liquid.

Preferably the digester is part of a two-vessel hydraulic system, which includes an impregnation vessel operatively connected to the inlet to the digester. In that case, step (c) is practiced in part by continuously withdrawing liquid from the top of the digester to a top extraction, recirculating a part of the liquid with any entrained material, to the impregnation vessel, and continuously removing a part of the withdrawn liquid from the digester-impregnation vessel loop (typically feeding it to a flash tank). The removed liquid has dissolved lignin therein (i.e. is "black liquor"), and is handled in the same way that black liquor is conventionally handled.

Also according to the invention, in order to prevent hot cooking liquors from entering the recirculation line back to the impregnation vessel, and thus reacting with incoming uncooked chips (which would cause the cooking chemical to be consumed before extraction could occur and thus result in low or no residual cooking chemical in the extracted liquor, and subsequent non-uniform cooking), a cooling circuit is provided at the top of the digester after the top extraction. The other liquids withdrawn from a mid-point of the digester, and the bottom of a digester, which are recirculated are heated so that cooking does take place below the cooling circulation.

In order to convert from the complete countercurrent continuous cook according to the invention to conventional cooking techniques, an upper mid-point extraction screen, between the top extraction and the mid-point extraction, can be maintained in place, cut off by a valve. When the valve is open, and a valve from the top extraction to the flash tank closed, conventional EMCC® treatment may be practiced. Under these circumstances, a valve in a white liquor line for adding white liquor to the bottom circulation can also be opened, or alternatively white liquor can be added to the bottom circulation even during complete countercurrent cook.

The invention also comprises a continuous digester including: An upright hydraulic vessel having a top and a bottom. An inlet for cellulose material entrained in liquid at the top of the vessel. An outlet for cellulose pulp at the bottom of the vessel. A top extraction, adjacent the top of the vessel, for withdrawing liquid from the top of the vessel. A top circulation loop connected to the top extraction and including a first conduit for removing a substantial volume of liquid from that withdrawn through the top extraction and utilizing it so that it is not reintroduced into the vessel, and a second conduit for recirculating liquid not removed, so that it returns to the impregnation vessel. A mid-point extraction for withdrawing liquid from the vessel. A mid-point circulation loop connected to the mid-point extraction and for reintroducing liquid extracted from the mid-point extraction so that it flows upwardly in the vessel. A bottom extraction for withdrawing liquid from the vessel. And, a bottom extraction loop connected to the bottom extraction for reintroducing liquid extracted from the bottom extraction so that it flows upwardly in the vessel.

The top circulation may include an in-line drainer from which the first and second conduits extend, and the digester may be in combination with the hydraulic impregnation vessel connected to the inlet to the vessel and to the second conduit. A cooling recirculation loop may be connected to the digester adjacent, but below, the top extraction, including the cooler. An upper mid-point extraction may be provided between the top extraction and the mid-point extraction, including an extraction conduit; and a first valve means is disposed in the first conduit, and second valve means is disposed in the upper mid-point extraction conduit. A control, such as a computer control, controls the first and second valve means so that when one is open the other is closed. A flash tank is connected to the first conduit and the upper mid-point extraction downstream of the valve means. The extractions typically include screens mounted within the digester.

It is the primary object of the present invention to provide an advantageous apparatus and method for continuous countercurrent cooking of cellulosic fibrous material to produce cellulose pulp, and to provide versatility for switching back from the completely countercurrent cooking to more conventional cooking techniques. This and other objects of the invention will become clear from the detailed description of the invention and from the appended claims.

DETAILED DESCRIPTION OF THE DRAWINGS

Figure 1:
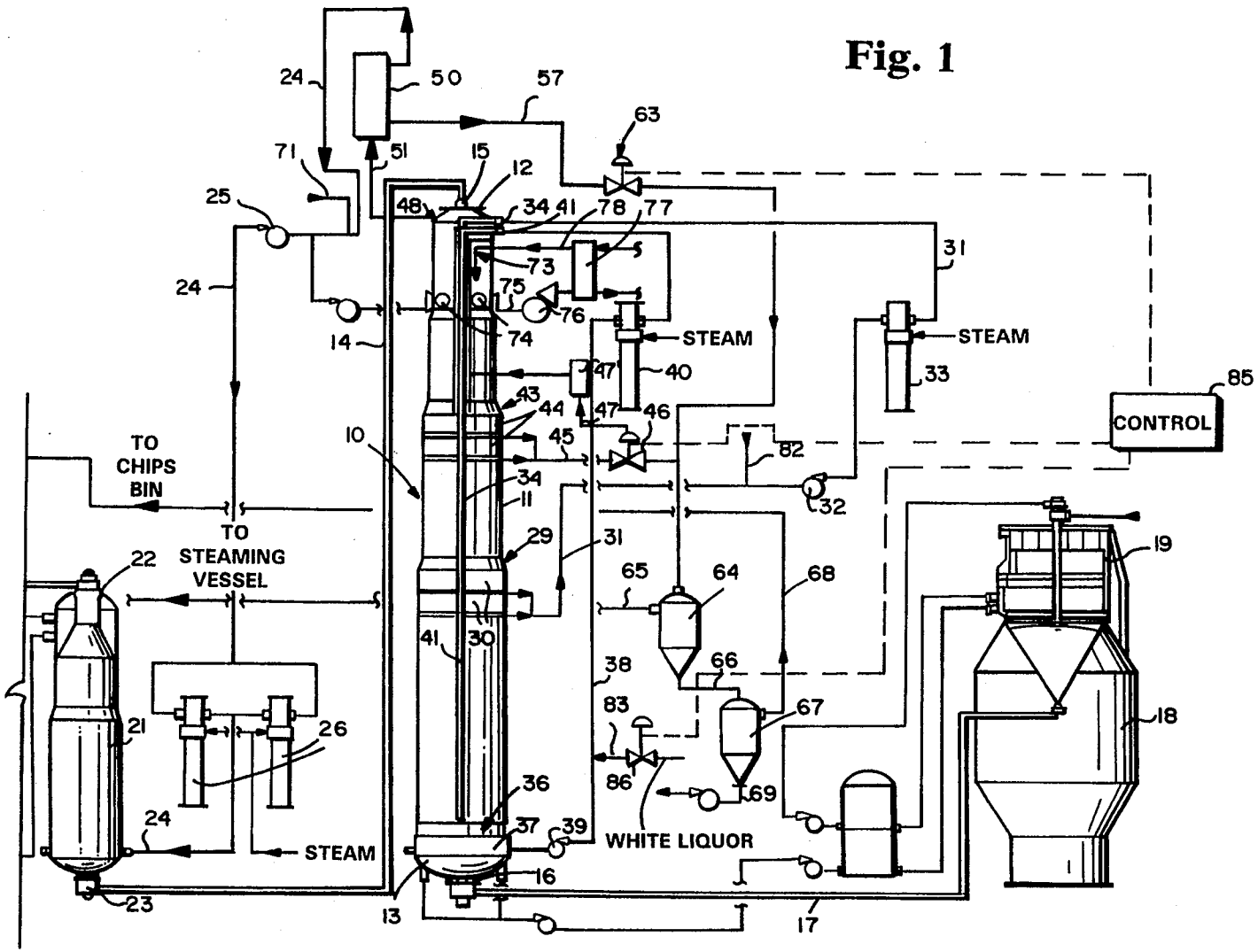
FIG. 1 is a schematic view of an exemplary continuous digester according to the present invention, shown interconnected to other cooperating components of a mill for producing cellulose pulp.

The apparatus illustrated in FIG. 1 comprises as the main component thereof a continuous digester 10, comprising an upright vessel 11 having a top 12 and a bottom 13. Leading into the top 12 is a line 14 to an inlet 15 at the top 12, the inlet 15 introducing comminuted cellulosic fibrous material (typically wood chips) entrained in cooking liquor (e.g. sulphate liquor, sulfite liquor, or the like). From the bottom 13 of the digester vessel 11, a pulp discharge 16 is provided, including a discharge line 17 leading to a high density storage tank 18 or the like, which may have a two stage diffusion washer 19 on top of it, as is conventional.

The components to which the digester 10 are connected are conventional for continuous digesters, such as those produced and marketed by Kamyr, Inc., of Glens Falls, N.Y. The components typically include a chips bin, chips meter, steaming vessel, high pressure feeder, sand separator, level tank, etc., which are well known and not shown in FIG. 1. Other conventional components typically also include a conventional hydraulic impregnation vessel 21 which includes a top separator 22 at the top thereof connected to the high pressure side of the conventional high pressure feeder, and an outlet device 23 at the bottom which is connected to the line 14. As is also conventional, some of the liquid is removed from the vessel 11 (which is a hydraulic vessel) at the top thereof through a line 24 having a pump 25 therein, and is heated by heaters 26 and then reintroduced through line 24 into the bottom of the impregnation vessel 21.

Also conventional and associated with the digester 10 is a mid-point extraction, shown generally by reference numeral 29, including one or more extraction screens 30 mounted within the vessel and an extraction conduit 31 extending therefrom connected to a pump 32, an MCC TM circulation heater 33, and a return conduit 34 which reintroduces the heated withdrawn liquor from the screens 30 back into the vessel 11 near the volume from which it was withdrawn. Also, as is conventional for a two vessel Kamyr, Inc., hydraulic digester set-up, a bottom extraction—shown generally by reference numeral 36—is provided, including an interior extraction screen 37 connected to an extraction line 38 having a pump 39 therein, a heater 40, and a reintroduction conduit 41 for reintroducing liquid withdrawn by the screen 30 back into the vessel 11 near the volume from where it was withdrawn.

A conventional continuous digester also has the upper mid-point extraction, shown generally by reference numeral 43, including interior screen or screen sets 44, and an extraction line 45. However according to the present invention the upper mid-point extraction 43 is eliminated, or a valve 46 inserted in the line 45 for purposes as will be hereinafter described. If desired, the extraction 43 may be used in conjunction with other extractions (through 48 and 74), and all extractions may be varied depending upon process conditions. This is shown schematically by extraction loop 47 and heater 47' in FIG. 1. This allows (depending on the control of valve 46, etc.) multi-step heating of the pulp, e.g., three-step heating, which will minimize the temperature gradient experienced by the chips, and thus reduce fiber damage.

Figure 2:
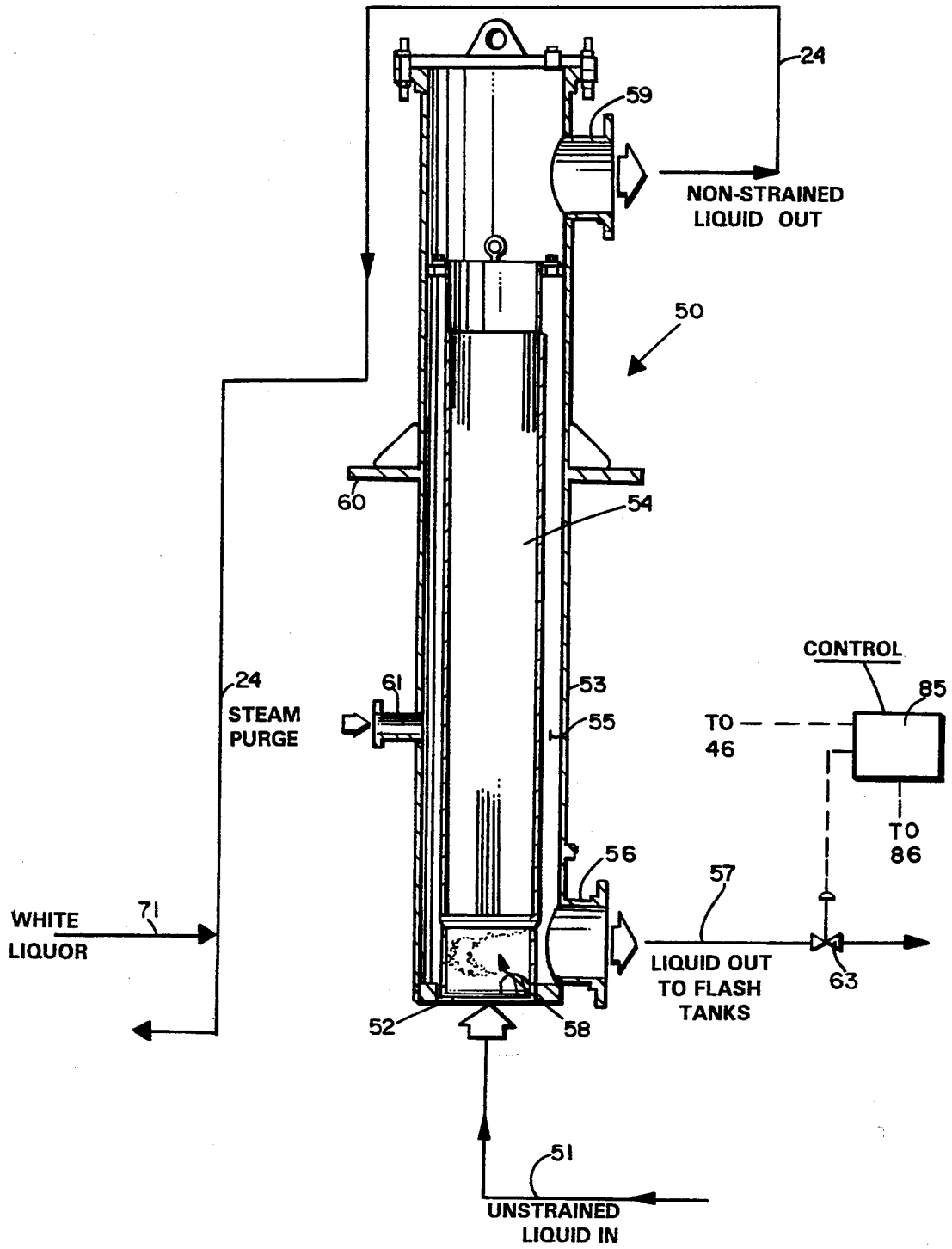
FIG. 2 is an enlarged schematic side view, partly in cross-section and partly in elevation, of an exemplary in-line drainer, of the apparatus of FIG. 1, shown interconnected to related components.

According to the present invention, there are several differences between the continuous digester 10 according to the invention and conventional hydraulic digesters. While a top extraction 48 is provided, as is conventional (and which may include a screen 49—see FIG. 3—although under some circumstances a screen is not necessary), instead of the otherwise conventional top extraction 48 being directly connected to the recirculation conduit 24 connected to the impregnation vessel 21, an in-line drainer 50 is provided. A conduit 51 (see FIGS. 1–3), connected to a header 51' (see FIG. 3) leads from the top extraction 48 into the bottom inlet 52 for the drainer vessel 53. Mounted within the vessel 53 (see FIG. 2) is a tubular screen 54 through which a substantial amount of liquid can pass into the annular area 55 between the screen 54 and the vessel 53, the removed liquor passing liquor through outlet 56 into a first conduit 57. Typically a screw flight, shown only schematically at 58 in FIG. 2, is provided at the inlet 52 to induce circular flow.

At the top of the in-line drainer vessel 53 is an outlet 59 connected to the conduit 24. The conduit 24 transports non-strained liquid, including entrained cellulosic fibrous material, back to the impregnation vessel 21. The in-line drainer 50 also may comprise an intermediate mounting flange 60, and steam purge 61, as is conventional for in-line top removal drainers marketed by Kamyr, Inc. of Glens Falls, N.Y.

The liquid discharge line 57 preferably is connected through a valve 63 to a first flash tank 64. Steam flashed in the tank 64 passes through line 65 to the conventional steaming vessel (not shown), while the liquid passes in line 66 to a second flash tank 67. Steam flashed in the second flash tank 67 passes in line 68 to the chips bin (not shown), while the removed liquid in line 69 is screened to remove fibers and then pumped to evaporators and ultimately to chemical recovery (for the manufacture of white liquor). As is also conventional, white liquor may be added in line 71 to the line 24 returning to the bottom of the impregnation vessel 21.

Also according to the present invention, it is desired to provide a cooling circulation adjacent the top of the digester 10, the cooling circulation being shown generally by reference numeral 73. The purpose of the cooling circulation 73 is to ensure that the liquids being returned to vessel 21 are not too hot, as a result of the completely countercurrent flow within the digester 10 which results from providing the top extraction 48 with in-line drainer 50. If the liquors withdrawn and recirculated in line 24 are too hot, they will react rapidly with the incoming chips so that the active alkali chemical is consumed before there is extraction. This can result in low or no residual cooking chemicals in the chips entering the digester 10, and thus result in non-uniform cooking.

The circulation loop 73 merely comprises a number of spaced withdrawal screens 74 (conventional trim screens—see FIGS. 1 and 3—only larger) disposed adjacent, but below, the top extraction 48 (and above the upper mid-point extraction 43), a recirculation line 75 extending from header 75' (see FIG. 3), pump 76, cooler 77, and reintroduction line 78. The cooler 77 reduces the temperature of the withdrawn liquid so that the adverse affects described above are minimized or eliminated.

In a typical method of continuously producing cellulose pulp utilized in a continuous digester 10, white liquor is added through conduit 71 into conduit 24, the liquid in conduit 24 is mildly heated by heaters 26, and introduced into the bottom of the impregnation vessel 21. Cellulose material entrained in the white liquor passes in conduit 14 to the inlet 15 at the top 12 of the digester vessel 11, the material forming a column within the vessel 11 and moving gradually and continuously downwardly within it. Liquid is withdrawn through extractions 48, 29, and 36, and ultimately reintroduced into the vessel 11 (through conduit 24 and impregnation vessel 21 for the top extraction 48, and through the recirculation loops including lines 31 and 38 for the mid-point and bottom extractions 29, 36 respectively). Also, a substantial volume of liquid (black liquor) is removed from that withdrawn by the top extraction 48 in in-line drainer 50, being fed by line 57 through valve 63 to a first flash tank 64. White liquor is introduced into the withdrawn liquid in line 31 via conduit 82, and optionally white liquor is introduced into the liquid in conduit 38 via conduit 83. Thus, a completely countercurrent flow between cooking liquor and material is established in the digester 10 throughout its height.

Also according to the method of the invention, if it is desirable to return the digester 10 to a more conventional operation, such as practicing the Kamyr, Inc. MCC TM or EMCC ® processes, a computer controller 85 controls the valves 46 and 63 to simultaneously close off the valve 63 and open the valve 46. The controller 85 may also control the pump 76 and the valve 86 (for introducing white liquor into line 38), and thus terminate the cooling circulation, and introduce white liquor into the conduit 38. The proportions of white liquor added at different points in the process will be determined using conventional criteria for MCC TM and EMCC ® digesters. If the screens 48, 74 are used to withdraw all of the extraction, then a new circulation loop 47 and heater arrangement 47' can be added, with appropriate control of valve 46; and white liquor can be added to the new circulation loop 47 to further even out the distribution of cooking chemicals.

Figure 3:
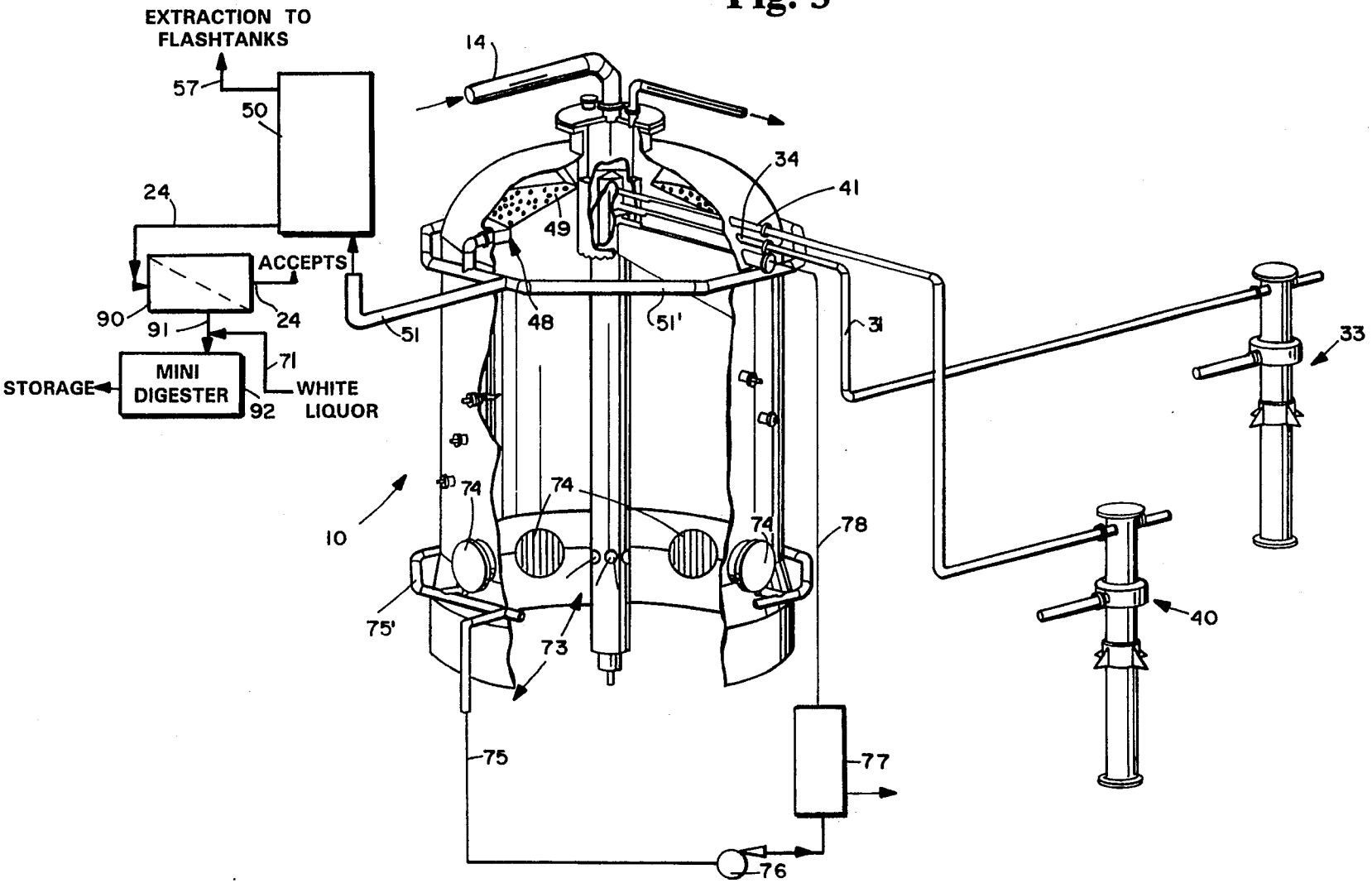
FIG. 3 is a schematic view, partly in cross section and partly in elevation, of details of the top of the digester and associated components from FIG. 1.

As seen in FIG. 3, the non-strained liquid in line 24 being withdrawn from the drainer 50 may be passed to pressure screen 90 with the "accepts" (primarily liquid) returned to the impregnation vessel 21 in line 24, while the fines are withdrawn from screen 90, white liquor from line 71 is added (it also may be added to the "accepts"), and the fines are treated at elevated time and temperature in a mini digester 92, and the produced pulp sent to storage or further treatment (e.g., added to the fiber line downstream of digester 10). Instead of using mini digester 92, the fines may be re-introduced into the main digester 10.

It will thus be seen that according to the present invention an advantageous method and apparatus have been provided for producing high quality paper pulp. Practicing the completely countercurrent cooking according to the invention it is possible to lower the temperature of the cook or to obtain better and more uniform temperature control, thus limiting the damage to fibers and resulting in increased strength and yield. Also the method and apparatus of the invention are flexible so that a digester can be returned, if desired, to conventional (e.g. EMCC ® process) operation for a predetermined period of time.

While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent methods and apparatus.

What is claimed is:

1. A method of continuously producing cellulose pulp from comminuted cellulosic fibrous material, utilizing an upright digester having a top and a bottom, comprising the steps of:

(a) continuously introducing comminuted cellulosic fibrous material entrained in cooking liquor into the top of the digester so that the material continuously moves downwardly in the digester;

(b) continuously withdrawing cellulose pulp from the bottom of the digester; and (c) establishing a countercurrent flow between cooking liquor and material throughout the entire height of the digester between the material introduction at the top and the pulp withdrawal at the bottom, including by continuously withdrawing liquid from the digester at a plurality of different points along the height of the digester, and reintroducing the withdrawn liquid; and wherein step (c) is practiced in part by continuously withdrawing liquid from the top of the digester through a top extraction, and recirculating a part of the liquid, with any entrained material, back to the digester.

2. A method as recited in claim 1 wherein step (c) is practiced, in part, by recirculating the liquid back to the digester through an impregnation vessel connected to the digester, and by continuously removing a part of the withdrawn liquid from the digester-impregnation vessel loop.

3. A method as recited in claim 2 comprising the further step (d) of withdrawing some liquid from adjacent the top of the digester but below the top extraction, and then cooling and reintroducing the liquid into the digester so as to prevent hot cooking liquors from entering the top extraction.

4. A method as recited in claim 2 wherein step (c) is further practiced at the top extraction utilizing an in-line drainer to remove part of the withdrawn liquid.

5. A method as recited in claim 4 wherein liquid removed from the in-line drainer is passed to flash tanks, and wherein liquid with entrained material is passed through a pressure screen, to remove fines, and then is recirculated to the digester.

6. A method as recited in claim 5 comprising further steps of treating the removed fines with white liquor, then digesting these fines in a mini digester to produce pulp.

7. A method as recited in claim 5 comprising the further steps of treating the removed fines with white liquor and returning those fines to the digester for further treatment.

8. A method as recited in claim 4 comprising the further step (d) of withdrawing some liquid from adjacent the top of the digester but below the top extraction, and then cooling and reintroducing the liquid into the digester so as to prevent hot cooking liquors from entering the top extraction.

9. A method as recited in claim 2 wherein step (c) is practiced by withdrawing liquid at one or more points in the digester besides the top extraction; and heating the withdrawn liquid and then reintroducing the heated withdrawn liquid directly into the digester adjacent the one or more points from which it was withdrawn.

10. A method as recited in claim 9 wherein step (c) is practiced by withdrawing liquid at a mid-point extraction and a bottom extraction and comprising the further steps of: (e) periodically terminating continuous removal of some of the liquid withdrawn from the digester at the top extraction, and substantially simultaneously with step (e), (f) withdrawing liquid from an upper mid-point extraction, between the mid-point extraction and the top extraction, the liquid withdrawn from the upper mid-point extraction not being re-introduced into the digester; and (g) continuing the practice of steps (e) and (f) for a first period of time.

11. A method as recited in claim 10 comprising the further step, during the first period of time when step (g) is being practiced, of (h) introducing cooking liquor into liquid being withdrawn and re-introduced from a bottom extraction.

12. A method as recited in claims 11 wherein step (h) is practiced only during the first period of time when step (f) is being practiced.

13. A method as recited in claim 10 wherein steps (e) and (f) are practiced by closing a valve from the top extraction, and opening a valve from the upper mid-point extraction.

14. A method as recited in claim 10 wherein step (f) is also practiced by introducing the liquid withdrawn from the upper mid-point extraction into a flash tank.

15. A method as recited in claim 2 comprising the further step of introducing cooking liquid into the liquid being withdrawn and reintroduced from the mid-point extraction.

16. A method as recited in claim 2 wherein the removed liquid from the top extraction is passed to a flash tank.

17. A method as recited in claim 1 wherein the cooking liquor is selected from the group consisting essentially of sulphate liquor and sulfite liquor.

18. A method as recited in claim 1 further comprising effecting three-stage heating of the material in the upper part of the digester to minimize the temperature gradient the material experiences, and thus minimizing fiber damage.

* * * * *